US007607188B2

(12) United States Patent
Singhal

(10) Patent No.: US 7,607,188 B2
(45) Date of Patent: Oct. 27, 2009

(54) INTEGRATED APPARATUS FOR TEETH CLEANING

(76) Inventor: Tara Chand Singhal, P.O. Box 5075, Torrance, CA (US) 90510

( * ) Notice: Subject to any disclaimer, the term of this patent is extended or adjusted under 35 U.S.C. 154(b) by 690 days.

(21) Appl. No.: 11/021,583

(22) Filed: Dec. 24, 2004

(65) Prior Publication Data

US 2005/0138741 A1 Jun. 30, 2005

Related U.S. Application Data

(60) Provisional application No. 60/532,378, filed on Dec. 24, 2003.

(51) Int. Cl.
*A46B 9/04* (2006.01)

(52) U.S. Cl. ..... 15/104.94; 15/167.1; 15/210.1; 15/114

(58) Field of Classification Search ..... 15/209.1–210.1, 15/167.1, 104.93, 104.94, 106, 114, 159.1, 15/160, 229.11; 433/80; 604/1; 606/161
See application file for complete search history.

(56) References Cited

U.S. PATENT DOCUMENTS

| | | | | |
|---|---|---|---|---|
| 2,186,832 | A * | 1/1940 | Hertzberg | 15/114 |
| 3,337,893 | A * | 8/1967 | Fine et al. | 15/111 |
| 4,856,136 | A * | 8/1989 | Janssen | 15/244.3 |
| D354,626 | S * | 1/1995 | Hurwitz | D4/116 |
| 5,437,372 | A * | 8/1995 | Per-Lee | 206/581 |
| 5,491,866 | A * | 2/1996 | Simonds | 15/167.1 |
| 5,944,519 | A * | 8/1999 | Griffiths | 433/80 |
| 6,205,611 | B1 * | 3/2001 | Vigil | 15/244.1 |
| 6,289,547 | B1 * | 9/2001 | Narula et al. | 15/167.3 |
| 6,623,440 | B1 * | 9/2003 | Weldon | 604/1 |
| 2003/0108846 | A1 * | 6/2003 | Hoertsch | 433/216 |

* cited by examiner

*Primary Examiner*—Laura C Guidotti
(74) *Attorney, Agent, or Firm*—Steve Roeder Esq.

(57) ABSTRACT

This invention embodies six different teeth cleaning aspects in one teeth cleaning apparatus. These aspects are: (i) use of an abrasive surface supported by a pad that is rubbed for cleaning exposed and easily reachable part of the teeth, (ii) use of bristles for reaching spaces between teeth and gum lines and between two teeth, (iii) use of a sponge under the abrasive surface that delivers plaque cleaning and anti-bacterial agent to the teeth surface, (iv) use of a woven cloth like surface with the ability to absorb and remove the food/acid film from the teeth, (v) ability to clean teeth with little or no use of water, (vi) use of a one time throw away cleaning head for better hygiene.

20 Claims, 2 Drawing Sheets

INTEGRATED APPARATUS FOR TEETH CLEANING

CROSS REFERENCE TO RELATED APPLICATIONS

This application claims priority on Provisional Application Ser. No. 60/532,378, entitled "Integrated Apparatus for Teeth Cleaning" filed on Dec. 24, 2003, by Tara Chand Singhal. The contents of Provisional Application Ser. No. 60/532,378 are incorporated herein by reference.

FIELD OF THE INVENTION

The present invention is directed to an integrated apparatus for cleaning teeth that integrates different methods of cleaning and a method of manufacture of the same.

BACKGROUND

Cleaning teeth presents many challenges. The food fibers and particles get stuck between teeth. The food enzymes and saliva in the mouth react to create a residue film that attaches to the teeth surface and hardens to become plaque. Naturally occurring color in the food create a stain on the teeth that is hard to remove. Bacteria acquire a hold on the food residue and causes cavities. Finely processed foods acquire glue like property and stick to the teeth. Food and snacks are consumed through out the day, while the teeth are usually cleaned only once or twice in a day. To overcome these challenges, there have been developed many ways to clean teeth. These are briefly summarized here.

A toothbrush may be used with or without toothpaste to clean the teeth. There have been many improvements in the toothbrush design. One such improvement has been, in using different color bristles in different parts of the brush. These colors, in some brands, are used to indicate the life of the bristles and in some other brands highlight different parts of the brush. Other improvements have been in using a mix of different heights or lengths of the bristles. Some times the bristles are at different angle orientation to each other and the base of the brush. These improvements in toothbrushes have been to improve the ability of the bristles to reach different part of the teeth surfaces and thus provide more effectively cleaning.

Other supplementary tooth cleaning means have been use of dental floss and toothpicks to reach spaces between teeth. There have also been tiny pointed brushes to reach and clean between teeth. There has also been development of tooth whitening means such as use of teeth whitening strips. Dental hygienist in Dentists' offices also uses ultrasonic cleaning tools to remove plaque. They polish teeth with a mechanized rubber surface that is rotated on the tooth surface with an abrasive compound to remove stains.

Other recent improvements in toothbrushes have been to add an automatic rotary or sliding mechanism to the toothbrush head. In addition, as an aid to teeth cleaning, there has been plaque softening and removing agent, which is used as supplement to using toothbrushes. There have also been antibacterial mouth-washing liquids that are used for killing germs and freshening the breath.

In spite of all these advances in teeth cleaning and use of toothbrushes, there is still a need for better teeth cleaning apparatus. Therefore, it is an objective of this invention to provide better teeth cleaning apparatus.

SUMMARY

This invention embodies many different teeth cleaning aspects in one teeth cleaning apparatus. These aspects, it is believed, provide more effective, more complete, and more cost effective teeth cleaning than any of the means currently available.

These aspects are: (i) use of an abrasive surface supported by a pad that is rubbed for cleaning exposed and easily reachable part of the teeth, (ii) use and placement of bristles for reaching spaces between teeth and gum, (iii) use and placement of conical edges and bristles for reaching spaces between two teeth (iv) use of a sponge under the abrasive surface that delivers plaque cleaning and anti-bacterial agent to the teeth surface, (v) use of a woven cloth like surface with the ability to absorb and remove the food/acid film from the teeth, (vi) ability to clean teeth with little or no use of water, and (vii) use of a hygienic one-time throwaway teeth cleaning head. The integrated teeth cleaning apparatus enables a person to more effectively and efficiently clean teeth with this one apparatus.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts.

DESCRIPTION

Introduction

Figure 1B:
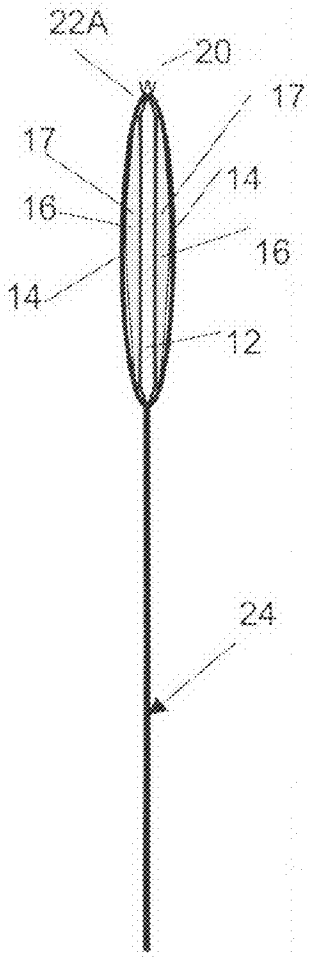
FIG. 1B shows a cross section view across X-X' that illustrates a version of the current invention of the teeth cleaning apparatus.
Figure 1A:
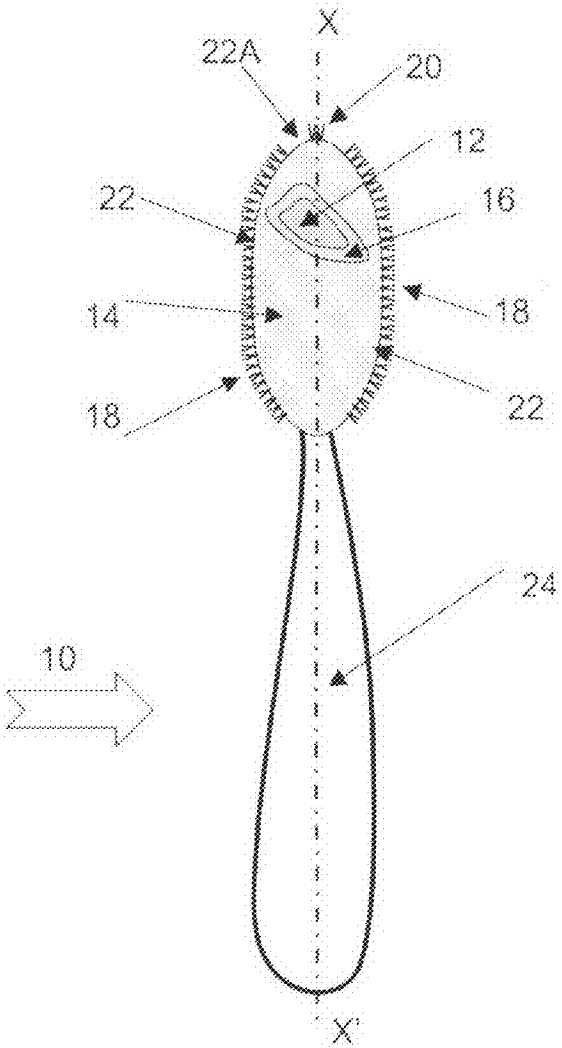
FIG. 1A shows plan view that illustrates a version of the current invention of the teeth cleaning apparatus.

With initial reference to FIG. 1A, a plan view is shown of an integrated teeth cleaning apparatus 10. The plan view also shows cut out views of the materials 12 and 16 that are hidden under material 14. With reference to FIG. 1B, a cross section view across X-X' is shown.

The apparatus 10 has a pad 12, an abrasive cleaning surface 14, and a handle means 24 attached to the pad 12 to hold the apparatus 10. The surface 14 has bristles that are placed on the edges of the surface 18. Additional bristles 20 are placed at the blunt part 22A of the pad. The pad 12 is enclosed in the surface 14. A sponge like substance 16 with the ability to absorb and hold cleaning agent 17 are placed inside the surface 14 next to and supported by the pad 12.

The apparatus 10 enables a person to more effectively and efficiently clean teeth with this one apparatus. For example the flat part of the surface 14 is rubbed against the teeth. It is believed, that rubbing with an abrasive surface 14 is more effective in removing stain and food film from the teeth than using the bristles of a toothbrush. The pad 12 with an abrasive surface 14, using handle 24 enables force to be applied against the teeth in pressing and then rubbing against the teeth the surface 14. This, it is believed, provides more effective cleaning than with a toothbrush alone. The sharp edge 22 along with bristles 20 is more effective in reaching spaces between teeth. The bristles 18 situated along the sides of the surface 14 are effective in reaching naturally occurring pocket between the teeth and gum lines. The sponge 16 soaks and holds cleaning agents 17 that are released automatically when the surface 14 is pressed and rubbed against the teeth.

The apparatus 10 is for one time used and may be sold in a sealed pouch (not shown), enabling a hygienic use as opposed to a toothbrush that may harbor germs. These and other aspects of the invention are described here, where the headings are provided for the convenience of the reader.

Pad 12

Figure 2B:
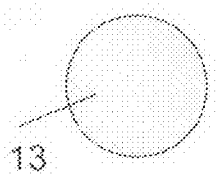
FIG. 2B illustrates another version of the pad that may be used in a current invention of the teeth cleaning apparatus.

The pad 12 is used to support the abrasive surface 14 and is substantially a flat surface that may be of different shapes. For example, FIG. 1B shows an oblong surface and FIG. 2B shows a circular surface 13. Other shapes may be possible and are not ruled out. The pad may be made of wood or it may be made of plastic or a semi-rigid rubber like material.

The pad 12 provides a support structure for the abrasive surface 14 when the surface 14 presses and rubbed against teeth. The shape of the pad 12 is intended to have a flat side and a sharp edge side 22. With these shape features of the pad, when the pad is covered with the surface 14, it can be used to rub against easily reachable part of teeth surface and can also be used to reach and rub against spaces between two teeth.

Abrasive Surface 14

Figure 2C:
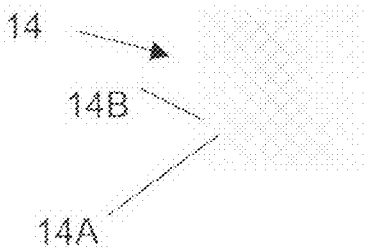
FIG. 2C illustrates a version of the abrasive surface that may be used in a current invention of the teeth cleaning apparatus.
Figure 2A:
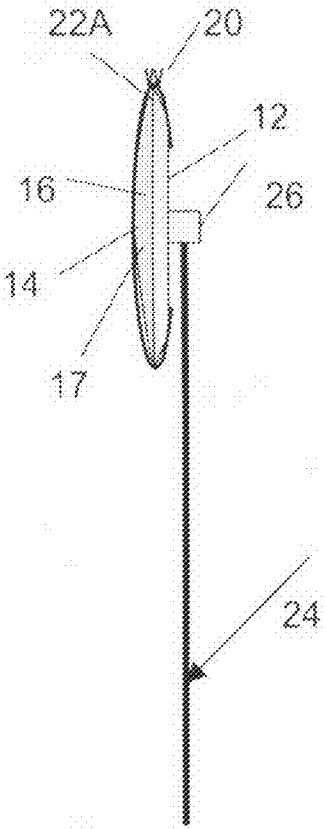
FIG. 2A shows a cross section view that illustrates another version of the current invention of the teeth cleaning apparatus.

The abrasive cleaning surface 14 may be attached to a plurality of sides of the pad 12. As shown in FIG. 1B, it may be attached to both sides of the pad including the edges of the pad. Alternatively, as shown in FIG. 2A, it may be attached to one side of the pad including the edges of the pad.

The surface 14 is used to rub against teeth surface to abrasively remove food film, food debris, and including plaque. The abrasive surface may be a woven material. As shown in FIG. 2C, the abrasive surface may be made of a woven fiber that has ridges 14A and valleys 14B on the surface, wherein the ridges and valleys together act to remove food residue and place the residue in the valleys when the abrasive surface 14 is rubbed against teeth.

The surface may be woven of floss material. The surface may be waxed or un-waxed as the floss can be also waxed or un-waxed. Some floss materials, for example, Oral B® brand floss also absorb food residue. Alternatively the surface may be woven of another suitable material that may be natural such as cotton or synthetic such as nylon, or it may be a combination of synthetic or natural fibers.

The abrasive surface 14 may also be integrally formed with the pad 12 and may be made of a plastic material suitable for this purpose. Then the abrasive surface may be made of a material in which ridges 14A and valleys 14B are formed, where they act to remove plaque and store in the valleys when the surface is rubbed against teeth.

Sponge Substance 16

Optionally, a sponge like substance 16 is placed between the pad 12 and the abrasive surface 14, enabling the surface 14 to shape to the curvature of a tooth when the pad 12 is pressed against a plurality of teeth.

The substance 16 may be soaked with a plurality of agents 17. Such agents may include microbial agent, plaque softening agent and mouth freshening liquid agent. The agents 17 may be released into the abrasive surface 14 when sponge 16 is squeezed. The microbial agent, plaque-softening agent, and mouth freshening agent are commonly available in products from manufacturers with brands such as VIADENT, PLAX and LISTERINE.

The sponge like substance may be of density that may be suitable for this purpose. For example, and as a simplified illustration, the surface 14 and the sponge 16 may be similar to what is commonly used in abrasive dishwashing sponge pads where a sponge is enclosed in nylon netting.

Bristles 18

As shown in FIG. 1A, the surface 14 may have bristles 18 attached at extremities of the surface 14. The bristles 18 along the longitudinal side of the surface 14 are of size and shape to allow them to reach inside naturally occurring pocket between teeth and gum. There may be additional bristles 20 that are placed on the conical edge 22 of the pad 12. These bristles 20 are of size and shape to allow the bristles to reach space between two teeth. The bristles may be made of synthetic fibers that are commonly used in toothbrushes.

Handle Means 24

With reference to FIGS. 1A, the pad has a handle 24 that may be integrally formed with the pad. Alternatively, as shown in FIG. 2A, the pad has a handle attachment means 26, for attaching a handle 24. In one embodiment the handle attachment means 26 pivotally attaches the handle 24 to the pad 12. This embodiment may enable the pad to be placed in different orientations on the teeth with the help of the pivotally attached handle.

In one embodiment the handle attachment means 26 fixedly attaches the handle 24 to the pad 12. This embodiment may enable the pad to be placed in different orientations on the teeth with the help of the pivotally attached handle.

In another embodiment the handle 24 may be of half size that may be held with fingers only. In a different embodiment, the handle may be full size to allow the handle to be held by the fingers and supported by the palm.

Method of Manufacture

The apparatus 10 may be manufactured economically using the following manufacturing steps:

(i) Molding an integrated pad 12 and a handle 24.

(ii) Molding an abrasive surface 14 with bristles 18 and 20 at the edges and of a size and shape to be able to surround the pad.

(iii) Attaching sponge 16 to the pad 12 and enclosing the pad 12 with the attached sponge 16 in the surface 14.

(iv) Soaking the combination of the pad 12, the sponge 16, and the surface 14 pad in a cleaning agent 17 and wrapping the apparatus in a hygienically sealed pouch.

An alternative method of manufacture of the apparatus 10 may use the following manufacturing steps:

(i) Molding a pad 12, a handle 24, and an abrasive surface 14 with bristles 18 at the edges.

(ii) Soaking the combination of the pad 12, the sponge 16, and the surface 14 pad in a cleaning agent 17 and wrapping the apparatus in a hygienically sealed pouch.

In another alternative method of manufacture of the apparatus 10 may use the following manufacturing steps:

(i) Molding a pad 12, an attachment means 26, a sponge 16, and an abrasive surface 14 with bristles 18 at the edges.

(ii) Soaking the combination of the pad 12, the sponge 16, and the surface 14 in a cleaning agent 17 and wrapping the apparatus in a hygienically sealed pouch.

(iii) Molding a handle that can be attached to the attachment means 26.

In summary, the integrated apparatus 10 provides more effective teeth cleaning and has many advantages over prior art teeth cleaning. These are: (i) use of an abrasive surface supported by a pad that is rubbed for cleaning exposed and easily reachable part of the teeth, (ii) use and placement of bristles for reaching spaces between teeth and gum lines and between two teeth, (iii) use of a sponge under the abrasive surface that delivers plaque cleaning and anti-bacterial agent to the teeth surface, (iv) use of a woven cloth like surface with the ability to absorb and remove the food/acid film from the teeth, (v) ability to clean teeth with little or no use of water, and (vi) use of a hygienic one-time throwaway teeth cleaning head.

While the particular method and apparatus as illustrated herein and disclosed in detail is fully capable of obtaining the objective and providing the advantages herein before stated, it is to be understood that it is merely illustrative of the presently preferred embodiments of the invention and that no limitations are intended to the details of construction or design herein shown other than as described in the appended claims.

What is claimed is:

1. A teeth cleaning apparatus comprising:

a. a substantially flat resilient pad, with a plurality of flat surfaces and a sharp edge surrounding the flat surfaces, the flat surfaces sized to cover a plurality of teeth surfaces and a handle that is integrally attached with the pad;

b. an abrasive cleaning surface, that is attached to the plurality of the flat surfaces of the pad;

c. bristles that are positioned only at the sharp edge of the pad are integrally attached to the pad.

2. The apparatus as in claim 1, further comprising:

a compressible material having absorbing property, impregnated with a microbial cleaning agent, is attached to the abrasive surface, enabling, when the pad is pressed against a plurality of teeth, the abrasive surface to shape to the curvature of a tooth and the cleaning agent to be released into the abrasive surface.

3. The apparatus as in claim 1, further comprising:

the abrasive cleaning surface is made of a woven fiber to remove food residue when the abrasive surface is rubbed against teeth.

4. The apparatus as in claim 1, further comprising:

the abrasive cleaning surface made of a material in which ridges and valleys are formed, where they act to remove food residue when the surface is rubbed against teeth.

5. The apparatus as in claim 1, further comprising:

the bristles along the sharp edge of the pad are of size and shape to allow them to reach inside naturally occurring pocket between teeth and gum.

6. The apparatus as in claim 1, further comprising:

the sharp edge is sized to reach space between two teeth.

7. The apparatus as in claim 1, further comprising:

a part of the bristles that are positioned on the sharp edge of the pad are of size and shape to allow the bristles to reach space between two teeth.

8. The apparatus as in claim 1, further comprising:

the pad shaped in one of a form of (i) a substantially oblong shape where a length side is greater than a width side to cover a plurality of teeth surface, or (ii) the pad shaped in a substantially circular shape to cover one or more teeth.

9. The apparatus as in claim 1, further comprising:

the pad has a handle attachment means, for attaching the handle, the handle attachment means pivotally attaching the handle to the pad.

10. A teeth cleaning apparatus comprising:

a. a substantially flat resilient pad, with a plurality of flat surfaces and a sharp edge surrounding the flat surfaces, the flat surface sized to cover a plurality of teeth surfaces and a handle that is integrally attached with the pad;

b. an abrasive cleaning surface that is attached to the plurality of the flat surfaces of the pad;

c. a compressible material having absorbing property, impregnated with a microbial cleaning agent, is attached to the abrasive surface, enabling, when the pad is pressed against a plurality of teeth, the abrasive surface to shape to the curvature of a tooth and the cleaning agent to be released into the abrasive surface.

11. The apparatus as in claim 10, further comprising:

bristles that are positioned only at the sharp edge of the pad.

12. The apparatus as in claim 11, further comprising:

the bristles along the sharp edge of the pad are of size and shape to allow them to reach inside naturally occurring pocket between teeth and gum.

13. The apparatus as in claim 11, further comprising:

a part of the bristles that are positioned on the sharp edge are of size and shape to allow the bristles to reach space between teeth.

14. The apparatus as in claim 10, further comprising: the abrasive cleaning surface has ridges and valleys on the surface, wherein the ridges and valleys together act to remove food residue and place the residue in the valleys when the abrasive surface is rubbed against teeth.

15. The apparatus as in claim 10, further comprising:

the pad shaped in one of a form of (i) a substantially oblong shape where a length side is greater than a width side to cover a plurality of teeth surface, or (ii) the pad shaped in a substantially circular shape to cover one or more teeth.

16. A hygienic, onetime use, teeth cleaning apparatus comprising:

a. a substantially flat resilient pad, with a plurality of flat surfaces and a sharp conical edge surrounding the flat surfaces, and a handle means that is integrally attached with the pad;

b. an abrasive cleaning surface that is attached to the plurality of the flat surfaces of the pad;

c. a compressible material having absorbing property, impregnated with microbial and plaque-cleaning agents placed under the abrasive surface;

d. bristles that are integrally attached to the pad, are positioned only at the sharp edge of the pad, and protrude through the abrasive surface.

17. The teeth cleaning apparatus as in claim 16, comprising:

the bristles along the sharp edge of the pad are of size and shape to allow them to reach inside naturally occurring pocket between teeth and gum.

18. The one time use, teeth cleaning apparatus as in claim 16, comprising:

the abrasive cleaning surface made of a material in which ridges and valleys are formed, where they act to remove residue when the surface is rubbed against teeth.

19. The teeth cleaning apparatus as in claim 16, comprising:

the apparatus is sealed in a hygienic onetime use throwaway package.

20. The teeth cleaning apparatus as in claim 16, comprising:

the handle means is half size in length that enables only fingers of a hand to hold the apparatus.

* * * * *